US005716258A

United States Patent [19]

Metcalf

[11] Patent Number: 5,716,258

[45] Date of Patent: Feb. 10, 1998

[54] SEMICONDUCTOR WAFER POLISHING MACHINE AND METHOD

[76] Inventor: Robert L. Metcalf, 7810 SW. Danielle Ave., Beaverton, Oreg. 97008

[21] Appl. No.: 753,517

[22] Filed: Nov. 26, 1996

[51] Int. Cl.[6] ..... B24C 47/00

[52] U.S. Cl. ..... 451/41; 451/285; 451/287

[58] Field of Search ..... 451/41, 285, 287, 451/288, 289, 397, 398

[56] References Cited

U.S. PATENT DOCUMENTS

| | | | |
|---|---|---|---|
| 3,603,042 | 9/1971 | Boettcher . | |
| 3,731,435 | 5/1973 | Boettcher et al. . | |
| 3,747,282 | 7/1973 | Katzke . | |
| 4,009,539 | 3/1977 | Day . | |
| 4,193,226 | 3/1980 | Gill, JR. et al. . | |
| 4,194,324 | 3/1980 | Bonora et al. . | |
| 4,270,316 | 6/1981 | Kramer et al. . | |
| 4,316,757 | 2/1982 | Walsh | 451/460 |
| 4,450,652 | 5/1984 | Walsh | 451/288 |
| 4,512,113 | 4/1985 | Budinger . | |
| 4,519,168 | 5/1985 | Cesna . | |
| 4,680,893 | 7/1987 | Cronkhite et al. . | |
| 4,918,870 | 4/1990 | Torbert et al. . | |
| 5,081,795 | 1/1992 | Tanaka et al. . | |
| 5,135,349 | 8/1992 | Lorenz et al. . | |
| 5,142,173 | 8/1992 | Konno et al. | 310/67 R |
| 5,153,841 | 10/1992 | Goff et al. . | |
| 5,205,082 | 4/1993 | Shendon et al. . | |
| 5,238,354 | 8/1993 | Volovich . | |
| 5,423,716 | 6/1995 | Strasbaugh | 451/287 |
| 5,443,416 | 8/1995 | Volodarsky et al. . | |
| 5,476,414 | 12/1995 | Hirose et al. | 451/41 |
| 5,527,209 | 6/1996 | Volodarsky et al. | 451/41 |
| 5,593,341 | 1/1997 | Thibaut | 451/41 |

*Primary Examiner*—Eileen P. Morgan

*Attorney, Agent, or Firm*—Klarquist, Sparkman, Campbell, Leigh & Whinston LLP

[57] ABSTRACT

A semiconductor wafer polishing machine and method are described in which a motor driven rotating spindle is coupled to the wafer carrier by a flexible coupling element. The carrier is releasably attached to a load transfer plate by a vacuum pressure chamber to enable removal of the carrier for loading and unloading of wafers prior to and after polishing. The motor and spindle together with the load transfer plate and carrier are moved between and raised rest position and a lowered polish position by a positioning cylinder. A load pressure bellows applies a polishing load force to the load transfer plate through an air lubricated thrust bearing to urge the wafers on the carrier against a rotating polishing table for polishing the wafers. The air bearing isolates the load force of the bellows from the rotational force of the spindle and allows sliding movement of the load plate relative to the bellows. The carrier, load transfer plate and the polishing table may all be made of rigid foam material, such as metal or ceramic, in order to reduce the mass and weight of these elements while providing them with a strong rigid construction.

20 Claims, 3 Drawing Sheets

SEMICONDUCTOR WAFER POLISHING MACHINE AND METHOD

FIELD OF THE INVENTION

The subject matter of the present invention relates to polishing machines and methods of polishing thin flat plates or wafers, and in particular to semiconductor wafer polishing machines and methods. Thus the polishing machine and polishing method of the present invention is especially useful in polishing flat wafers of semiconductor material used to produce electronic devices including integrated circuit devices.

BACKGROUND OF THE INVENTION

It has previously been proposed in U.S. Pat. No. 4,194,324 of Bornora et al. issued Mar. 25, 1980 to provide a semiconductor wafer polishing machine including a wafer carrier in the form of a solid plate having a load bearing flange of circular configuration supported on its upper surface by a plurality of webs which extend inwardly and outwardly of the flange to increase the strength of the carrier and to dissipate the heat produced in the carrier during polishing. The carrier is coupled to a rotating head by vacuum pressure and the head is connected by a spherical ball and socket type connector to a rotating drive shaft. The rotating drive shaft is hollow and is provided with a vacuum passage within which a spring biased valve is mounted for controlling the air pressure applied to the interface between the carrier and the rotating head in response to the polishing force to release such vacuum pressure during polishing. The polishing machine of the present invention does not employ these features and is capable of more accurate polishing of the flat surface of the wafer. Thus the wafer polishing machine of the present invention employs a wafer carrier with a rigid foam core for low mass and high strength. It also employs a flexible kinematic coupler to couple the rotation of a motor driven shaft to the wafer carrier through a load transfer plate and employs a separate adjustable load pressure device for applying polishing pressure to the transfer plate through an air thrust bearing which isolates the load pressure device from the rotational force.

A wafer polishing machine is shown in U.S. Pat. No. 5,443,416 of Volodarsky et at. issued Aug. 22, 1995 that includes a wafer carrier coupled to a rotary drive shaft by a flexible diaphragm which is in the form of a flexible disk like membrane that also serves as a pressure seal for a load pressure chamber within the rotating polishing head which applies a load pressure to the carrier during polishing through the diaphragm by means of an air source which is coupled through a rotary coupling to such chamber during polishing. This wafer polishing machine has a perforated carrier plate with a region having passages there through from the top surface to the bottom surface and a cushioning pad in communication with the wafer held on such bottom surface to enable easier removal of the wafer after polishing. The carrier is mechanically tilted relative to the polishing table on which the polishing grit is supported by a felt layer to enable easier removal of the wafers from such felt after polishing. In addition, a retaining ring is provided around the carrier to provide a pocket for insertion of the wafer so that it is in alignment with the carrier. Also, a lifting shelf and lifting prongs are employed for mechanically tilting of the carrier during removal of the wafer. These features result in an extremely complicated wafer polishing machine which is difficult to operate satisfactorily and are not employed in the polishing machine of the present invention. In addition, because the shaft rotation force for rotating the carrier and the load pressure force for pressing the carrier towards the polishing table are both transmitted through the same flexible diaphragm in such patent there is no way to separate these forces and independently adjust them as is true of the present invention. Thus in the polishing machine of the present invention the load force for urging the carrier toward the polishing table is applied to a load transfer plate through a bearing separately from the rotational force applied by the flexible coupling. The load force is produced by a pneumatic bellows or other equivalent device and is transmitted through an air lubricated thrust bearing to the load transfer plate to reduce friction and to isolate the load force pressure device from the rotation coupling element.

U.S. Pat. No. 5,205,082 of Shendon et al. issued Apr. 27, 1993 shows a wafer polishing machine which is similar to that of U.S. Pat. No. 5,443,416 in that it employs a rotatable polishing head connected to a wafer carrier by a flexible diaphragm that also functions as a membrane seal for an air pressure chamber which applies a load pressure to the carrier through the diaphragm to urge the wafer against the polishing surface. Thus the flexible diaphragm functions not only as a flexible coupling for applying the rotational force to the carrier but also functions to apply the load pressure force to the carrier during polishing. U.S. Pat. No. 5,081,795 of Tanaka et al. issued Jan. 21, 1992, shows a similar teaching. In addition, the polishing head employs a retainer ring around the carrier to provide a pocket for receiving the wafer on the carrier. Such polishing head employs positive pressure and a movable stop to extend the carrier downward beyond the retaining ring to enable the wafer to be removed from the carrier after polishing. In both of these prior polishing machines the load pressure transmitting diaphragm which also serves as the flexible coupling for coupling the carrier to the rotating head, rotates and moves vertically in the direction of the Z axis due to load pressure changes and variation in the thickness of the wafer during polishing. This vertical and rotational movement of the diaphragm causes corresponding movement in the axis of rotation of the carrier which results in inaccurate polishing of the wafer so that it is not polished as flat as it otherwise could be. The polishing machine of the present invention overcomes this problem by not applying the load pressure to the carrier through the flexible rotation coupling but instead applying the load pressure through an air thrust bearing to isolate it from the rotational source.

Another cause of inaccuracy in polishing is the irregular movement and vibration of the carrier due to the high mass of the solid metal carrier used for the rotating polishing head in the above patents which produces an undesirable effect on polishing accuracy. The polishing machine of the present invention avoids this problem by employing rigid foam core elements for the carrier and the load transfer plate which reduces their mass and increases their resonant vibration frequency for easier dampening. The air bearing in the polishing machine of the present invention permits greater freedom of tilting for the carrier and its load transfer plate. Also, the air bearing isolates the load pressure source from the rotating force of the spindle which is coupled to the load transfer plate by a flexible coupling. The tilting of the load transfer plate relative to the load pressure source in the present invention is enabled by the air bearing which slides relative to the load transfer plate. In addition, the air bearing provides a dampening effect on any resonant vibration of the carrier or the load transfer plate which might otherwise be transmitted across the air film of such bearing thereby reducing vertical axis movement of the carrier during polishing and producing a flatter surface finish on the wafers.

It has also been proposed in U.S. Pat. No. 4,918,870 of Torbert et al. issued Apr. 24, 1990 to provide a wafer polishing machine in which a plurality of floating sub-carriers are mounted on a conventional wafer carrier in an attempt to provide low cost polishing wafers. However, the polishing machine of this patent employs a mechanical spring or pneumatic/hydraulic devices for axial loading of the sub-carrier. By failing to isolate the polishing load force on the sub-carrier from the rotational device for rotating the sub-carrier the polishing machine of Torbert does not produce highly accurate flat polishing of the wafers.

U.S. Pat. No. 3,603,042 of Boettcher issued Sep. 7, 1971 and U.S. Pat. No. 3,731,435 of Boettcher et al. issued May 8, 1973 show polishing machines in which the carrier is coupled to a rotating shaft by a vacuum and the carrier is cooled by fluid flowing through the carrier to dissipate the heat produced during polishing. Also these patents show the use of valve means for changing the pressure applied to the head to retain the wafer or the work piece on the head and to release it once polishing is finished.

SUMMARY OF THE INVENTION

One object of the present invention is to provide an improved wafer polishing machine and method which is capable of polishing thin, flat plates or wafers to a high degree of uniform flatness.

Another object of the invention is to provide an improved semiconductor wafer polishing machine and method of high accuracy, employing a motor driven spindle coupled to the wafer carrier by a flexible coupling element for rotation of the carrier which enables the semiconductor wafer to conform to the surface of the polishing device for more accurate polishing of the wafer.

A further object of the present invention is to provide such a semiconductor wafer polishing machine and method employing a wafer carrier with a rigid foam core of metal or ceramic to provide the carrier with a rigid construction of high strength and low mass for more accurate polishing.

Still another object of the invention is to provide such an improved semi-conductor wafer polishing machine and method in which the wafer carrier is releasably coupled to a load transfer plate so that the carrier can be quickly and easily removed from the polishing machine.

An additional object of the present invention is to provide such an improved semi-conductor wafer polishing machine and method in which an adjustable polishing load force for urging the wafer carrier and the wafer mounted therein against a rotating polishing device, is coupled to the load transfer plate through an isolation connection separate from the flexible coupling element which applies a rotational force to such carrier, to enable adjustment of the polishing load force independently of the rotational force for more accurate polishing.

A still further object of the invention is to provide such an improved semi-conductor wafer polishing machine and method in which the polishing load force is applied to a load transfer plate through an air lubricated thrust bearing to isolate such load force from the rotational force transmitted to such load plate for more accurate polishing of the wafer to a uniform thickness.

The foregoing and other objects, features, and advantages of the invention will become more apparent from the following detailed description of a preferred embodiment which proceeds with reference to the accompanying drawings.

DETAILED DESCRIPTION OF A PREFERRED EMBODIMENT

Figure 1:
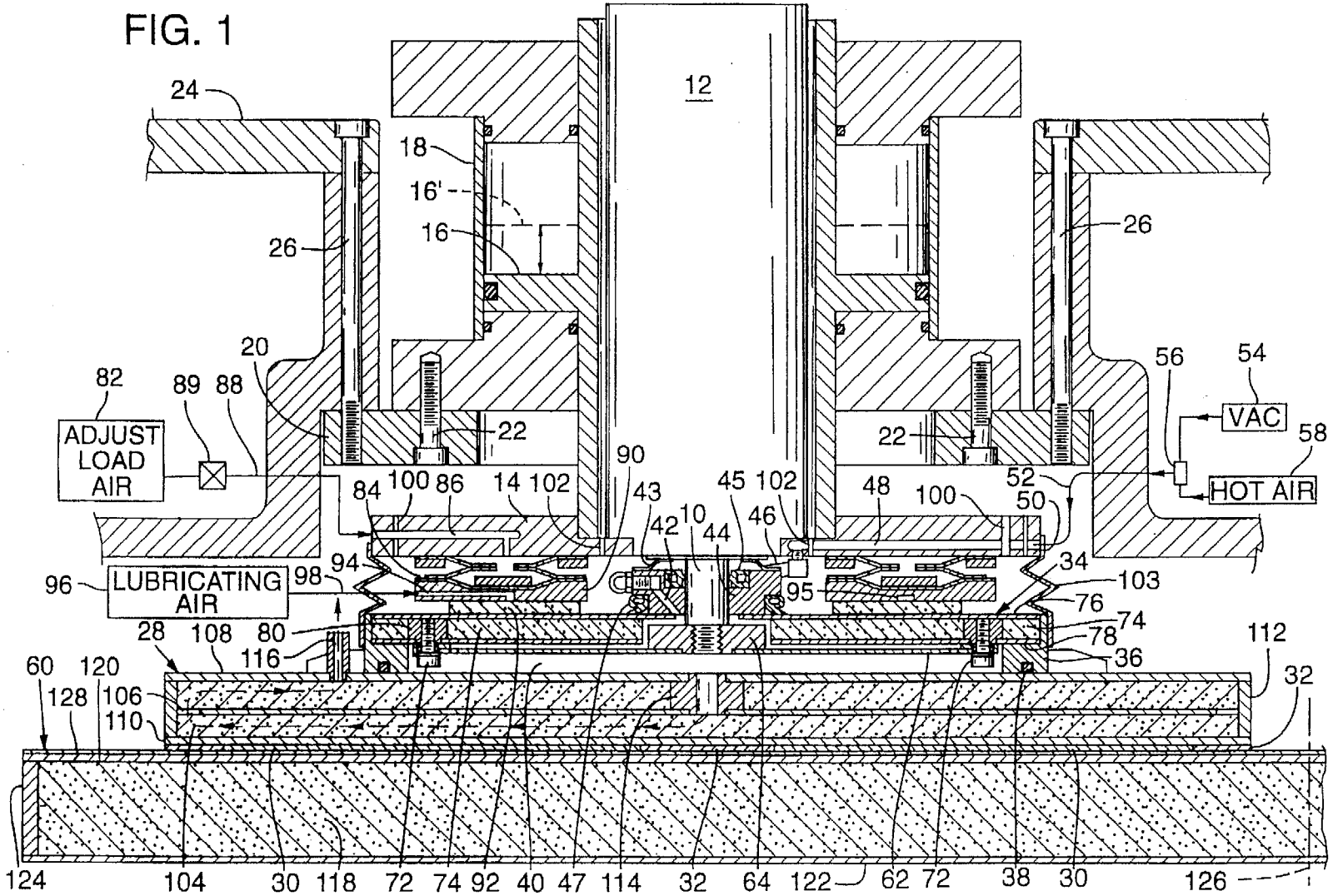
FIG. 1 is a vertical sectional view of the semiconductor wafer polishing apparatus of the present invention.

A semi-conductor wafer polishing machine in accordance with the preferred embodiment of the present invention, as shown in FIG. 1 includes a motor driven spindle 10 which is rotated by a DC voltage powered electric motor 12 supported on a mounting plate 14. The motor is connected to the spindle through a reduction gearbox (not shown). The mounting plate 14 is attached to the lower end of a piston 16 in a positioning cylinder 18, for moving the spindle 10 and motor 12 between a raised rest position 16' and a lowered polish position 16. The cylinder 18 may be a pneumatic actuated cylinder of conventional type except that the piston 16 is hollow and of sufficient internal diameter to accommodate the mounting of the motor 12 therein. The positioning device 18 moves the piston 16 between the lowered polish position 16 shown in solid lines in FIG. 1, and a raised rest position 16' shown in dashed lines in FIG. 1. The positioning cylinder 18 is fixedly attached to a support plate 20 by bolts 22. The support plate is mounted on a frame 24 of the wafer polishing machine by mounting bolts 26. Thus, the piston 16 moves the mounting plate 14 the motor 12 and the spindle 10 up and down relative to the frame 24 between the raised rest position 16' and the lowered polishing position 16 during the operation of the wafer polishing machine. The positioning device 18 could be a pneumatic bellows rather than a cylinder or it may be replaced by a mechanical positioning device such as a rack and pinion apparatus with a manually operated or motor driven pinion mounted on the frame 24 and a rack attached to the motor 12 for raising and lowering the motor.

A circular wafer carrier plate 28 has a plurality of circular semiconductor wafers 30 mounted thereon by attachment in a conventional manner to the bottom surface of such carrier such as by supporting the wafers within circular pockets provided on a flexible plastic mounting template 32. The carrier is rotated by the rotating spindle 10 in a manner hereafter described. The carrier plate 28 is secured by vacuum pressure to a load transfer plate 34 to enable removal of the carrier plate for replacement of the wafers after polishing. The load plate 34 includes an external flange 36 secured to the outer edge of such load plate. The flange 36 is provided with a friction drive ring 38, such as a rubber o-ring, mounted in an annular groove on the bottom thereof which forms a vacuum seal with the top surface of the carrier plate 28 and also serves as a friction drive for rotation of such carrier plate in response to rotation of the load transfer plate 34 by the spindle 10.

A sealed pressure chamber 40 is formed between the load transfer plate 36 and the top of the carrier plate 28 which releasably connects the carrier plate to such load plate by vacuum pressure for rotation by the spindle 10 when the carrier 28 is in the raised rest position 16' of the positioning cylinder piston and as it is moving between such rest position and the lowered polish position 16 of such cylinder.

Figure 2:
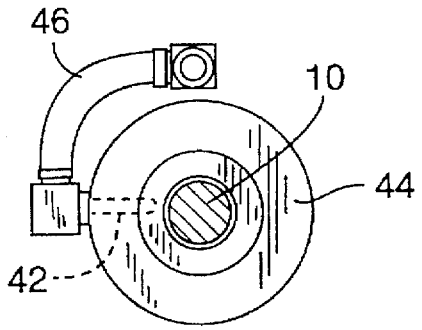
FIG. 2 is a horizontal sectional view taken through the spindle of FIG. 1 above the shaft bushing and air connector.

It should be noted that the carrier 28 may be releasably connected to the load plate 36 by other means than vacuum pressure, such as a magnetic coupling or a quick release mechanical connection. The pressure chamber 40 is connected to a source 54 of vacuum pressure through a passageway 42 in a shaft bushing 44 which surrounds and supports the lower end of the spindle 10 and is urged by leaf spring 43 downward into contact with the upper surface of the load transfer plate 34. The bushing 44 is sealed to the shaft 10 by a first rotary seal 45 and is sealed to the load plate 34 by a second seal 47. As shown in FIG. 2, the passageway 42 is connected by an external tubing 46 to a connecting passageway 48 in mounting plate 14 having an air inlet 50 on the side of mounting plate 14. The air inlet 50 is connected through tubing 52 to a source 54 of a vacuum pressure through an electrically operated valve 56 in one position of such valve. The valve 56 when moved to a second position is disconnected from the vacuum source and is connected to a source of hot air 58 at positive pressure for heating the carrier 28 during polishing. Thus when the carrier 28 is moved down to the polish position the valve 56 disconnects the vacuum source 54 and connects the hot air supply 58 to the passage 52, 48, 46 and 42 which transmits the hot air to the pressure chamber 40. The hot air heats the carrier 28 and the wafers 30 during polishing and thereby reduces the polishing time. It should be noted that in the polish position the vacuum holding force is unnecessary because the carrier is pressed against a rotary platen or polishing table 60 by a polishing load force produced by an adjustable load pressure device and applied to the load transfer plate 34 in a manner hereinafter discussed.

The rotating spindle 10 is connected to the load transfer plate 34, by a flexible kinematic coupling element 62. The coupling element has a thin circular resilient sheet metal body fixed to a central connector disk 64 having a threaded hole which receives the threaded end of the spindle 10. The central disk 64 is secured to the sheet metal body of the flexible coupling element 62 by welding or other suitable fixed connection.

Figure 3:
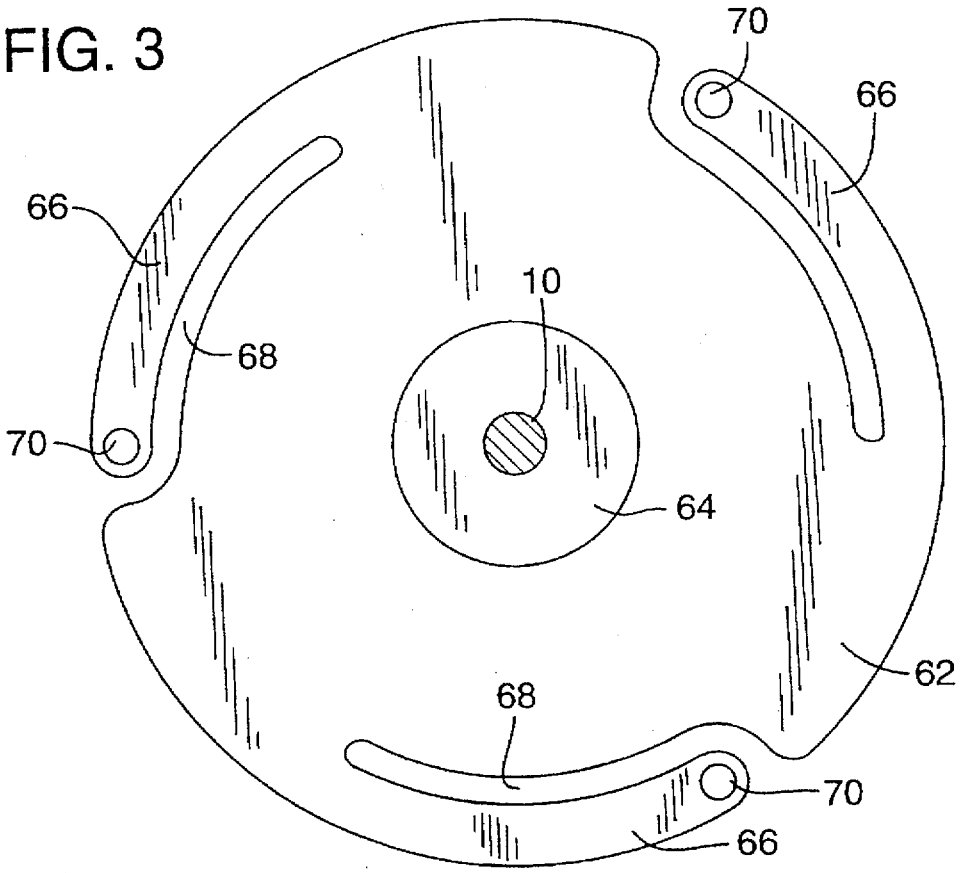
FIG. 3 is an enlarged plan view of the flexible coupling element in the apparatus of FIG. 1.
Figure 4:
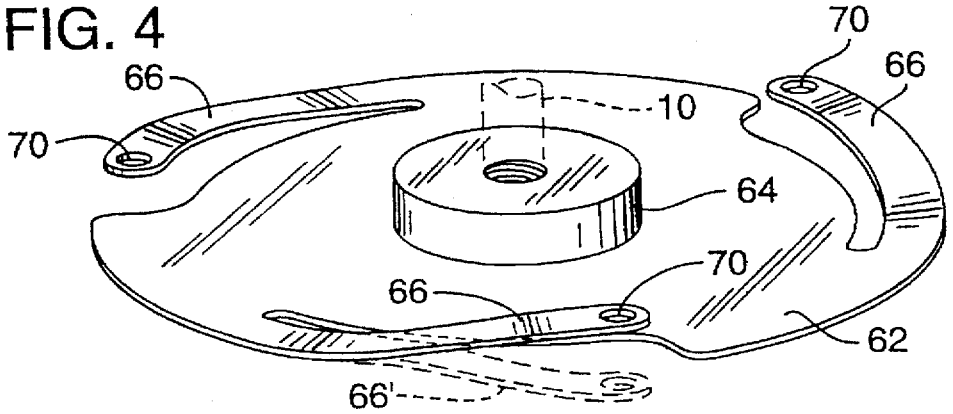
FIG. 4 is an oblique side elevation view of FIG. 3

As shown in FIGS. 3 and 4, the flexible coupling element 62 is a circular metal sheet which includes three or more resilient flexible arms 66 projecting therefrom and uniformly spaced around the periphery of such plate and which are separated by elongated slots 68 from the main body of a metal plate. The coupling element 62 is made of stainless steel or other resilient metal to enable flexing movement of such arms upward and downward from their normal position in the plane of the coupling element. The outer ends of the three coupling arms 66 are fixed through connection holes 70 to the load transfer plate 34 by three bolts 72 as shown in FIG. 1. A spacer washer is provided around each of the bolts 72 to space the end of each flexible coupling element 62 from the bottom of the transfer plate 34 sufficiently to enable up and down flexing movement of the coupling arms 66. As shown in FIG. 4, the coupling arm 66 may flex upward from the plane of the coupling element 62 or downward therefrom during rotation of such coupling element depending upon the thickness of the wafers 30 and the load force applied to the load transfer plate 34.

The load transfer plate 34 and the carrier plate 28 may both be made of a composite construction including a rigid foam core of metal or ceramic material which reduces the mass and weight of these plates while providing them with great strength and rigidity. Thus, the load transfer plate 34 is provided with a central core layer 74 of rigid foam material which may be foam ceramic material such as silicon carbide or aluminum oxide ceramic. A top surface layer 76 and a bottom surface layer 78 both of solid ceramic material such as silicon carbide or aluminum oxide are bounded to the opposite sides of the foam core 74 in any suitable manner such as by a epoxy resin adhesive. Threaded metal insert nuts 80 are fixed between outer layers 76 and 78 in holes within the foam core 74 in position to receive the mounting bolts 72. This composite load plate is also fastened to the outer metal flange 36 surrounding such plate by a epoxy resin or other suitable binding material to form the completed load transfer plate 34.

A load pressure source 82 of regulated positive air pressure provides an adjustable load force for urging the carrier 28 toward the polishing device 60 during polishing by means of an adjustable air pressure device 84, such as a pneumatic bellows which is mounted on the lower surface of the mounting plate 14. The bellows 84 is coupled through an air passage 86 in mounting plate 14 to the air pressure source 82 by external tubing 88 through a pressure adjustment valve 89. The bellows 84 is provided with a lower support plate 90 to which an air lubricated thrust bearing 92 is attached extending downward therefrom. The air lubricated thrust bearing 92 may be made of porous carbon graphite material which is sufficiently porous to allow lubricating air to flow therethrough. The lubricating air flows through the air bearing from a supply channel 94 formed in the bottom surface of the bellows support plate 90 and having an annular channel portion 95 in the center of the support plate. The air channel 94 is connected to an external source 96 of lubricating air by an external connecting tube 98. Thus, lubricating air flows from the source 96 through tubing 98 to passageway 94 and downward from the annular portion 95 of passageway 94 into the top of air bearing 92 and exits from the bottom of such air bearing at the interface between the bottom of air bearing and the top surface of the upper layer 76 of the load transfer plate 34. This provides a lubricating air film at such interface which greatly reduces the friction between the air bearing 92 and the load transfer plate 34 which is caused by the rotation of such transfer plate relative to such air bearing and the downward load force exerted on the air bearing by the bellows 84. It should be noted that the load pressure air source 82 is connected to a regulated source of air pressure and the air pressure transmitted to the bellows 84 may be adjusted by adjustment valve 89. The air transfered through the air bearing 92 is exhausted through vent openings 100 and 102 in the mounting plate 14 with vent openings 102 venting through the space between the motor 12 and the sidewall of the piston 16 to cool the motor. A dust seal bellows 103 is connected between the outer edge of mounting plate 14 and the load transfer plate 34 at flange 36 to prevent dust from entering the air bearing 92.

As shown in FIG. 1 the wafer carrier 28 is provided with a rigid foam core 104 which may be made of foam metal such as aluminum or stainless steel or it may be made of a foam ceramic material such as silicon carbide or aluminum oxide. The foam core is divided into an upper core layer and a lower core layer by a solid divider plate 106 of the same material as the core. The carrier is provided with an upper layer 108 and a lower layer 110 of the same material as the core or of a different material having substantially the same thermal coeficient of expansion as the core. The core is bounded by an outer flange member 112 of solid material which is suitably fastened to the upper and lower layers 108 and 110 and is fastened to the intermediate divider plate 106, a central spacer 114 having an inlet passage therethrough for allowing heated air to enter into the porous core of the carrier 28 is mounted between layers 108 and 110. The heated air from source 58 circulates in the direction of the arrows around the ends of the divider plate 106 which are spaced from the flange 112 and exits through a plurality of check valves 116 positioned in the upper layer 108 to be spaced around the carrier. It should be noted that the check valves 116 one way valves which are closed when vacuum pressure is produced within the sealed chamber 40 by connection to vacuum source 54 and are opened by the positive pressure of the heated air from source 58.

In a similar manner the polishing platen or table 60 may also be provided with a rigid foam core 118 of ceramic material or metal and such table is provided with upper and lower layers 120 and 122 of solid ceramic or solid metal of the same thermal coefficient of expansion as the core. The polishing table also includes and outer flange portion 124 which is sealed to the upper layer 120 and the lower layer 122. The polishing table is rotated about its own axis 126 by its own motor (not shown).

Figure 5:
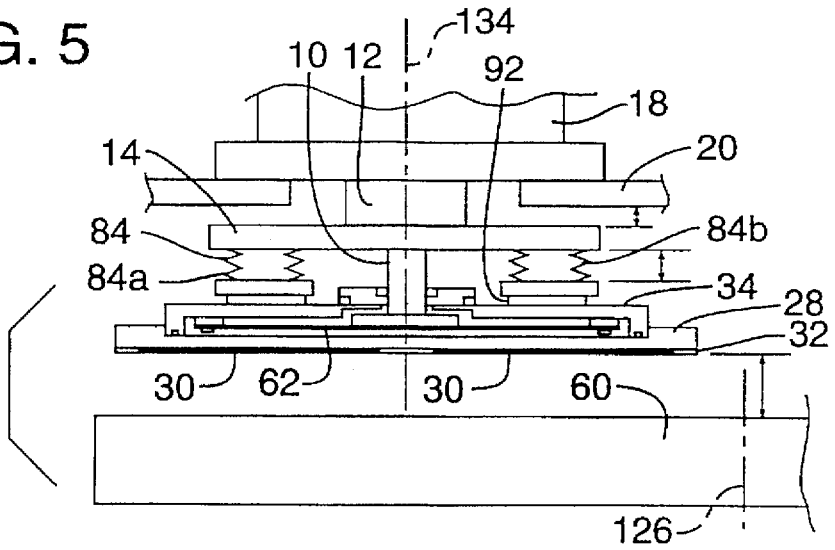
FIGS. 5 and 6, respectively, show the raised rest position and the lowered polish position of the apparatus of FIG. 1.
Figure 6:
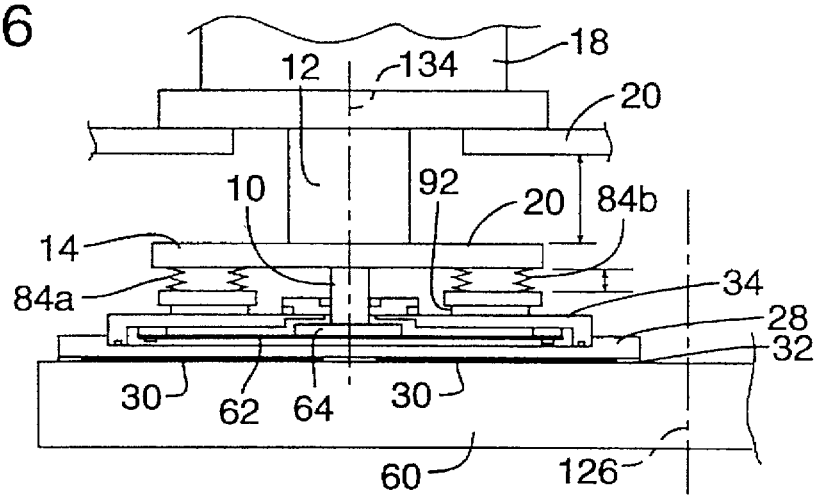

A polishing felt layer 128 is provided on the upper surface of the polishing table to hold the liquid slurry of abrasive polishing particles against the lower surface of the wafers 30 as such wafers are rotated by the carrier 28 in a conventional manner. The liquid slurry of abrasive particles (not shown) is deposited upon the felt prior to and during polishing in a conventional manner. As shown in FIG. 5, when the carrier 28 is raise upward to the rest position 16' of the positioning cylinder 18 the template 32 and the wafers 30 held thereon are separated from the felt 128. In this rest position, the wafers are removed from the carrier and new wafers are inserted into the template pockets for polishing. In FIG. 6, the wafer carrier 28 and the polishing table 60 are shown in the lowered polish position. As shown in FIG. 6, during polishing the bellows 84 is somewhat compressed compared to FIG. 5 due to the fact that the carrier 28 and the wafers 30 are urged against the polishing table 60. Also it should be noted that the mounting plate 14 and the motor driven spindle 10 are spaced below the frame support plate 20 by a greater amount in the polishing position of FIG. 6 rather than in the raised position of FIG. 5 due to the positioning cylinder 18 having moved its piston 16 down into the polishing position.

Figure 7:
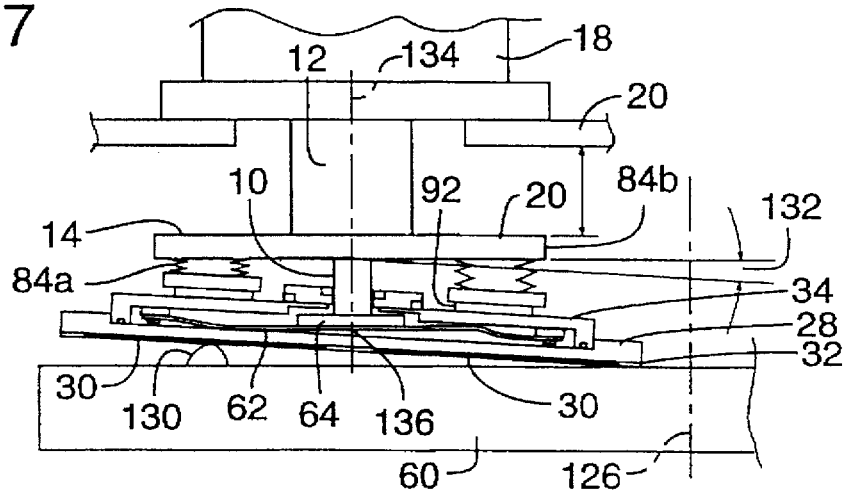
FIG. 7 is a side elevation view of the apparatus of FIG. 1 showing tilting of the carrier during polishing.

In FIG. 7 the polishing apparatus is shown with the carrier 28 and load plate 34 tilted at a tilt angle 132 with respect to the mounting plate 14 when a defect 130 occurs between the carrier and the upper surface of the polishing table 60 such as when the wafers or polishing felt 128 are not of uniform thickness. This tilting action has been greatly exaggerated in FIG. 7 for purposes of clarity. When this tilting occurs the flexible coupling plate 62 is bent into an S-shape so that the left side of the load transfer plate 34 is higher than its right side and similarly the left side of the carrier plate 28 is raised relative to its right side. This tilting movement is enabled by the flexible arms 66 of the flexible coupling plate 62 as shown in FIG. 4. Also, the bellows 84 of the load pressure device is tilted relative to the mounting plate 14 so that the left hand portion 84A of the bellows is more compressed than the right hand portion 84B of the bellows. When this tilting occurs, the coupling arms 66 of the flexible coupling element 62 are bent up and down during rotation of the spindle 10 about its axis of rotation 134. This causes the carrier 28 and the load plate to pivot about a pivot point 136 located at the point where the coupling element 62 crosses the axis of rotation 134 of the spindle. As a result the axis of rotation of the carrier plate 28 at the center of its lower surface in the plane where the wafers contact the polishing table 60, changes its position and orbits about the axis of rotation 134 of the spindle 110. This pivoting of the coupling element 62 about pivot 136 changes the effective radial length of the coupling arms 66 relative to the axis of rotation 134 of the spindle due to the flexing of the coupling element. As a result the load transfer plate 34 is caused to slip and slide sideways relative to the air bearing 92 but such air bearing accommodates the relative back and forth sliding movement or slippage of the load plate relative to the bellows 84. Thus the air bearing effectively isolates the load adjustment bellows 84 from the orbital movement of the axis of rotation of the carrier 28 relative to the spindle axis 134 and from the horizontal slip between the air bearing and the load plate. The flexible coupling and the air bearing enable the contact plane of the wafers 30 on the bottom of the carrier 28 with the table 60 to float so that it can move up and down and can tilt to accommodate different thicknesses of the wafers or non-uniformity in thickness of the polishing felt or polishing table, while enabling such wafers to be polished flat with a high degree of uniformity. It should be noted that center of pivot 136 remains fixed on the axis of rotation 134 of the spindle due to the fact that the connector disk 64 is the center of the flexible coupling element is rigid and is fixed to the spindle by threaded engagement therewith.

In view of the many possible embodiments to which the principles of our invention may be applied, it should be recognized that the illustrated embodiment is only a preferred example of the invention and should not be taken as a limitation on the scope of the invention. Rather, the scope of the invention is defined by the following claims.

I claim:

1. Semiconductor wafer polishing apparatus, comprising:

a carrier for supporting semiconductor wafers for movement with said carrier relative to a polishing device;

a spindle mounted for rotation by a drive motor;

a positioning device for moving the carrier between a rest position and a polish position;

a coupling for coupling the spindle to the carrier in said polish position to rotate said carrier, said coupling including a flexible coupling member connected between said spindle and a load transfer plate which is releasably coupled to the carrier;

a load adjustment device for applying an adjustable load force to the transfer plate during polishing through a connection separate from said flexible coupling member; and a thrust bearing for transmitting the load force from said load adjustment device to said transfer plate to urge the carrier toward the polishing device in said polish position while said carrier is rotating relative to said thrust bearing, to polish the wafers.

2. Apparatus in accordance with claim 1 in which the carrier is made of rigid foam core construction.

3. Apparatus in accordance with claim 1 in which the load adjustment device is connected to a source of fluid pressure to apply the load force to the transfer plate.

4. Apparatus in accordance with claim 1 in which the flexible coupling member is fixed to the spindle and has a plurality of flexible arms which are secured adjacent their ends to the transfer plate to provide a kinematic coupling.

5. Apparatus in accordance with claim 1 in which the positioning device is a pneumatic positioning cylinder.

6. Apparatus in accordance with claim 5 in which the motor and spindle are connected to a piston of the positioning cylinder for movement with said piston between the rest position and the polishing position.

7. Apparatus in accordance with claim 6 in which the piston has a hollow piston shaft which surrounds the motor and spindle.

8. Apparatus in accordance with claim 1 in which the thrust bearing is a pneumatic bearing having a gas lubricated bearing surface.

9. Apparatus in accordance with claim 8 in which the thrust bearing is an air bearing connected to a source of air pressure which caused air to flow through a porous bearing surface adjacent the transfer plate to provide a layer of air at the bearing surface for reduced friction.

10. Apparatus in accordance with claim 3 in which the load adjustment device is a pneumatic bellows.

11. A method of polishing wafers, comprising the steps of:

mounting said wafers on a carrier;

rotating said carrier by a motor driven spindle coupled to said carrier by a coupling;

moving said carrier from a rest position to a polish position where the wafer contacts a polishing device; and applying a load force to said carrier during polishing by a load force device connected to a source of load pressure, said load force device applying the load force to the carrier through a connection separate from said coupling to polish said wafers.

12. A method in accordance with claim 11 which also includes the step of coupling the rotational movement of a motor driven spindle to the carrier through a flexible coupler which is connected between the spindle, and a load transfer plate which is releasably coupled to the carrier by air pressure.

13. A method in accordance with claim 11 in which the load force is applied to the carrier through a pneumatic thrust bearing.

14. A method in accordance with claim 13 in which the load force is adjustable and the pneumatic bearing has air flowing through said bearing.

15. A method in accordance with claim 12 including the step of transmitting air through a porous carrier of rigid foam to heat or cool the carrier while it is in the polish position.

16. Semiconductor wafer polishing apparatus, comprising:

a carrier for supporting semiconductor wafers for movement with said carrier relative to a polishing device;

a spindle mounted for rotation by a drive motor;

a positioning device for moving the carrier between a rest position and a polish position;

a coupling for coupling the spindle to the carrier in said polish position to rotate said carrier, said coupling including a flexible coupling member connected between said spindle and a load transfer member which is releasably coupled to the carrier; and a load adjustment device for applying an adjustable load force to the transfer member during polishing through a connection separate from said flexible coupling member.

17. Apparatus in accordance with claim 16 in which the carrier is made of rigid foam core construction.

18. Apparatus in accordance with claim 16 in which the load adjustment device is connected to a source of air pressure to apply the load force to the transfer plate.

19. Apparatus in accordance with claim 16 which also includes a thrust bearing for transmitting the load force from said load adjustment device to said transfer member to urge the carrier toward the polishing device in said polish position while said carrier is rotating relative to the thrust bearing.

20. Apparatus in accordance with claim 19 in which the thrust bearing is an air bearing connected to a source of air pressure which caused air to flow through a porous bearing surface adjacent the transfer plate to provide a layer of air at the bearing surface for reduced friction.

* * * * *